US006583697B2

(12) United States Patent
Koyama et al.

(10) Patent No.: US 6,583,697 B2
(45) Date of Patent: Jun. 24, 2003

(54) TRANSFORMER

(75) Inventors: Takanori Koyama, Otokuni-gun (JP); Tatsuya Hosotani, Muko (JP); Hiroshi Takemura, Muko (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/872,428

(22) Filed: Jun. 1, 2001

(65) Prior Publication Data

US 2002/0017971 A1 Feb. 14, 2002

(30) Foreign Application Priority Data

Jun. 2, 2000 (JP) ..... 2000-166720

(51) Int. Cl.[7] ..... H01F 5/00

(52) U.S. Cl. ..... 336/83; 336/200; 336/223; 336/232

(58) Field of Search ..... 336/83, 200, 223, 336/232

(56) References Cited

U.S. PATENT DOCUMENTS 4,004,251 A * 1/1977 Hesler et al.
4,424,504 A * 1/1984 Mitsui et al. ..... 336/83
4,583,068 A * 4/1986 Dickens et al. ..... 336/82
5,760,669 A * 6/1998 Dangler et al. ..... 336/65
5,886,610 A * 3/1999 Canova ..... 336/83
6,252,487 B1 * 6/2001 Wolf et al. ..... 336/221
6,294,974 B1 * 9/2001 Fukumoto ..... 336/107

FOREIGN PATENT DOCUMENTS

JP 655222 7/1994
JP 670223 9/1994

* cited by examiner

*Primary Examiner*—Anh Mai
(74) *Attorney, Agent, or Firm*—Keating & Bennett, LLP

(57) ABSTRACT

A transformer including a first magnetic core and a second magnetic core having the shape of a flat plate. In the first magnetic core, a middle leg and substantially L-shaped outer legs whose inner sides are formed as circular-arc-shaped surfaces are provided in a standing manner at the central portion and at the comers of a rectangular flat plate, respectively. In addition, in the first magnetic core, a winding accommodating portion is formed between the circular-arc-shaped surfaces of the corresponding outer legs and an outer peripheral surface of the middle leg. Three coil portions, formed by spiral winding operations in level states, are placed upon each other, and are inserted into the winding accommodating portion of the first magnetic core. Then, from above the coil portions, the second magnetic core is placed thereon in order to form an integral structure. At this time, at the side portions of the flat plate, an external line of the flat plate and an external line of the winding accommodating portion coincide with each other. Therefore, the footprint of the transformer becomes small. Accordingly, in the invention, the transformer can be made smaller and thinner as a result of making the dead space that exists during the mounting of the coil to the magnetic core as small as possible.

20 Claims, 6 Drawing Sheets

TRANSFORMER

BACKGROUND OF THE INVENTION

1. Field of the Invention

The present invention relates to a transformer for use in communications devices or various power supplies, and, more particularly, to a transformer which can be reduced in size and which can be made thinner by an improved shape of a magnetic core.

2. Description of the Related Art

FIGS. 8A and 8B are sectional front and sectional plan views of a conventional transformer such as those disclosed in, for example, Japanese Unexamined Utility Model Application Publication Nos. 6-70223 and 6-55222. In these figures, a coil 3 is accommodated inside of a cylindrical outer leg 1 and disposed around a middle leg 2. Transformers which are combinations of E-type magnetic cores or which are combinations of E-type magnetic cores and I-type magnetic cores, with a coil being wound upon a middle leg thereof, have also been used. In the structures of such transformers, the sizes of the transformers are obtained by adding the sizes of the outer legs of the corresponding cores to the external sizes of the corresponding coils.

However, in the conventional structure whose size is obtained by adding the size of the outer leg of the corresponding core to the external size of the corresponding coil, the footprint area and overall size of the transformer become considerably greater than those of the corresponding coil, thereby resulting in the inconvenience that the transformer cannot be made sufficiently small and thin.

SUMMARY OF THE INVENTION

To address this problem, the present invention provides a transformer which can be made small and thin as a result of making the dead space that exists when mounting a coil to a magnetic core as small as possible.

In order to overcome the above-described problems, the present invention provides the following structural features.

(1) According to a basic form of the present invention, there is provided a transformer comprising a first magnetic core and a second magnetic core. The first magnetic core includes a middle leg provided in a standing manner at the central portion of a plate, preferably flat and polygonal in shape, and outer legs provided in a standing manner at a plurality of corners of the plate, in which a portion disposed between the middle leg and the outer legs is a winding accommodating portion having a shape for accommodating a winding. The second magnetic core is placed on the first magnetic core in order to be attached thereto, for example by means of an adhesive. In the transformer, a plurality of substantially planar coils, which are each formed by winding a wire in a planar or flat shape, are inserted into the winding accommodating portion and stacked upon each other.

A cross-sectional shape of the middle leg is at least partially curved, preferably circular or substantially elliptical. A curved portion of a cross-sectional outer peripheral shape of the middle leg has the shape of a circular arc formed concentrically with a curved portion of an outer peripheral shape of the winding accommodating portion. An outer periphery of the winding accommodating portion is formed so as to be close to or substantially coincide with corresponding side portions of an external boundary of the magnetic core.

In the basic form, the transformer is formed by placing the first and the second magnetic cores upon each other, and accommodating the coil therebetween. In the first magnetic core, a middle leg and outer legs are provided in a standing manner at the central portion and at the plurality of corners of the polygonal flat plate, with a portion disposed between the middle leg and the outer legs serving as a winding accommodating portion for accommodating a winding. In the case where the transformer is constructed in this way, when the coil is formed by winding a wire in a flat manner, and is accommodated inside the winding accommodating portion, the comers thereof are located at the corresponding outer legs, as a result of which the dead space becomes small, so that the footprint area of the entire transformer becomes small.

By forming the middle leg with either a circular shape or a substantially elliptical shape, the central portion of the coil can be fitted thereto without any gap, thereby making it possible to further reduce the amount of dead space.

Similarly, by forming the curved portion of the cross-sectional outer peripheral form of the middle leg into the shape of a circular arc formed concentrically with a curved portion of the outer peripheral boundary of the winding accommodating portion, and forming the outer periphery of the winding accommodating portion so that it is close to or coincident with a side portion of the external outline of the magnetic core, the footprint of the transformer can be minimized.

Since a coil lead can be drawn out from an opening at a portion where the outer periphery of the winding accommodating portion is adjacent to a corresponding side of the first magnetic core, it is no longer necessary to provide a separate opening for passing the lead therethrough.

A plurality of leads of the planar coil may be drawn out from different openings in the first magnetic core that are not located on a same straight line. Therefore, the transformer can be disposed at a greater variety of locations.

(2) The second magnetic core may have the shape of a flat plate. In this form, the coil formed by winding a wire in a flat shape is accommodated inside the winding accommodating portion formed inside the first magnetic core. By forming the entire winding accommodating portion inside the first magnetic core, the second magnetic core can be formed with the shape of a flat plate.

Alternatively, the first and the second magnetic cores can be formed with the same shape so that a portion of the winding accommodating portion is defined in each of the first and second magnetic cores. When this is done, it is possible to manufacture one fewer component part.

A winding width of the winding accommodating portion may be greater than a thickness of the winding accommodating portion, and the width of the transformer may be greater than its height. This contributes to reducing the thickness of the transformer.

(3) An area determined by the product of a cross-sectional peripheral length of the middle leg and a thickness of the polygonal flat plate may be substantially equal to or greater than a cross-sectional area of the middle leg; or the total sum of cross-sectional areas of the outer legs may be substantially equal to or greater than the cross-sectional area of the middle leg; or the total sum of areas of inwardly facing portions of areas determined by products of cross-sectional peripheral lengths of the corresponding outer legs and the thickness of the polygonal flat plate may be substantially equal to or greater than the cross-sectional area of the middle leg.

By virtue of this structure, it is possible to restrict the reduction of induction caused by the concentration of magnetic flux at other portions of the magnetic core.

Other features and advantages of the present invention will become apparent from the following description of the invention which refers to the accompanying drawings.

DETAILED DESCRIPTION OF EMBODIMENTS OF THE INVENTION

Figure 1:
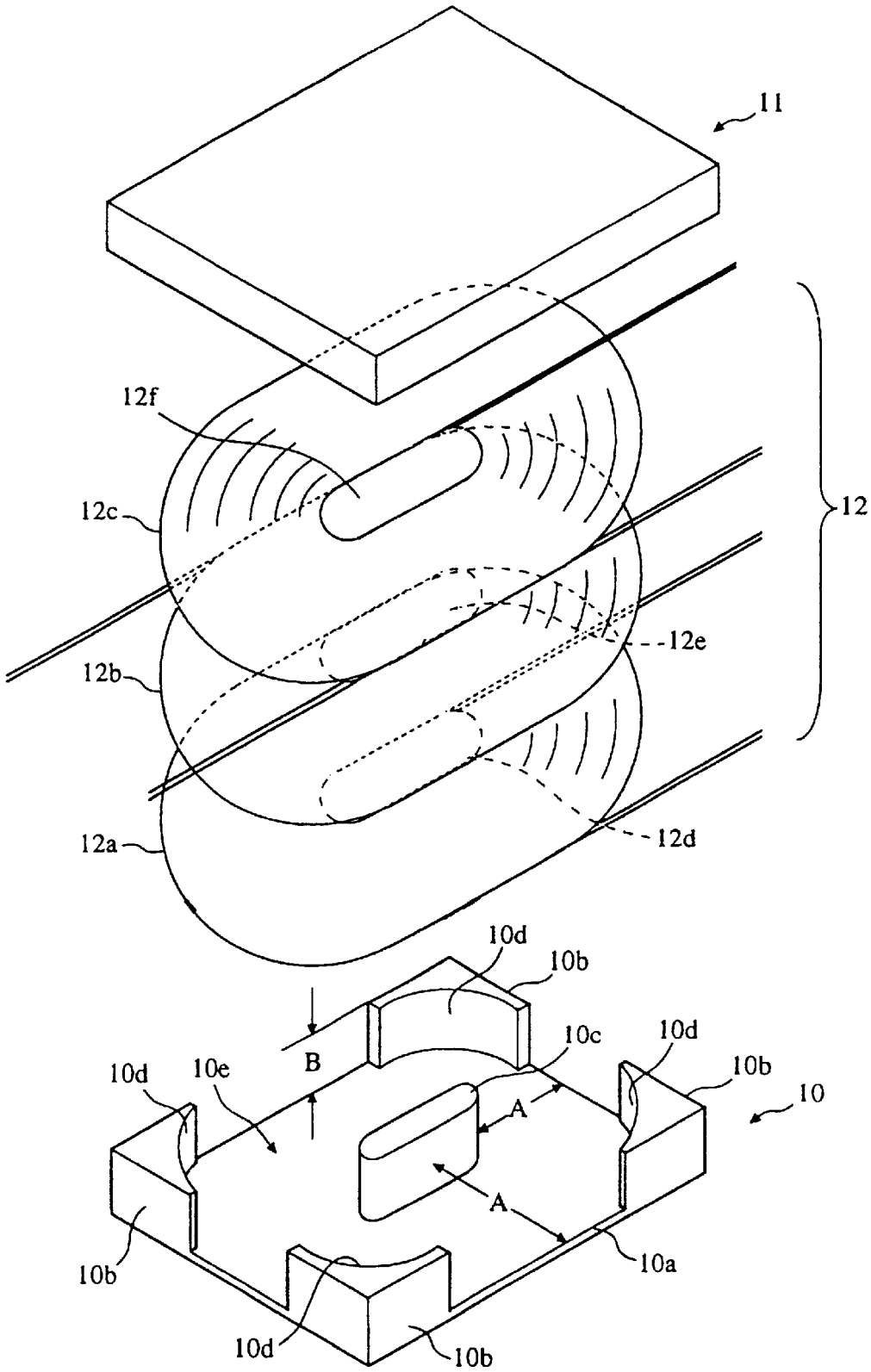
FIG. 1 is an exploded perspective view of an embodiment of a transformer in accordance with the present invention.

FIG. 1 is an exploded perspective view of an embodiment of a transformer in accordance with the present invention.

The transformer of the embodiment comprises a first magnetic core 10, a second magnetic core 11 which can be placed upon the first magnetic core 10 and secured integrally therewith, for example by use of a suitable adhesive, and a coil 12. The coil 12 comprises three layers that are stacked upon each other in the first magnetic core 10.

The first magnetic core 10 is formed of, for example, a ferrite material, and comprises a rectangular flat plate 10*a*, outer legs 10*b* provided in a standing manner at the four comers of the flat plate 10*a*, and a middle leg 10*c* provided in a standing manner at the center of the flat plate 10*a*. Each outer leg 10*b* is substantially L-shaped in cross-section, in plan view, with the inner side of each leg 10*b* being formed as a circular-arc-shaped surface 10*d*. Although in the embodiment the flat plate 10*a* used is rectangular, it does not need to be rectangular. It may have any shape. A polygonal shape is preferable for practical reasons well known to those skilled in the art.

In the embodiment, the middle leg 10*c* has a circular, elongated, or substantially elliptical cross-section in plan view. This shape is substantially the same as the shape of the center hole formed in the central portion of the coil (described later). Therefore, when the middle leg 10*c* is circular in cross section, the center hole of the coil is also circular. Similarly, when the middle leg 10*c* is elliptical in cross section, the center hole in the coil is also elliptical.

In the embodiment, the second magnetic core 11 is a flat plate, and, like the first magnetic core 10, is formed of, for example, a ferrite material.

In the above-described structure, inside the first magnetic core 10 is defined a winding accommodating portion 10*e* formed by the space defined by the inside circular-arc-shaped surface 10*d* of each outer leg 10*b*, the outer periphery of the middle leg 10*c*, and the edges of the flat plate 10*a* which extend between the outer legs 10*b*. The coil 12 is inserted in three layers that are placed upon each other into the winding accommodating portion 10*e*.

The curvature of a curved outer peripheral portion of the magnetic-core winding accommodating portion is a circular arc formed concentrically with a curved outer peripheral portion of the middle leg 10*c*. The shape of each inside surface 10*d* of each corresponding outer leg 10*b* defines the outer peripheral shape of this winding accommodating portion.

Coil portions 12*a*, 12*b*, and 12*c* of the coil 12 are formed by using a self-fusing, three-layer insulating wire, and spirally winding portions thereof in substantially flat shapes. Substantially elliptical holes 12*d*, 12*e*, and 12*f* whose shapes match the shape of the middle leg 10*c* of the first magnetic core 10 are formed in the central portions of the coil portions 12*a*, 12*b*, and 12*c*, respectively. The coil 12 is inserted in three layers that are placed upon each other in the winding accommodating portion 10*e*. Some are used as the primary windings and the others are used for the secondary windings. Since a three-layer insulating wire is used, it is easy to obtain an insulating structure between the primary and the secondary windings of the transformer. In addition, by alternately placing the primary and the second windings upon each other, the degree of coupling can be easily increased. Although in the embodiment, the coil 12 comprises three layers of coil portions that are placed upon each other, other numbers of coil portions may be used.

Figure 2A:
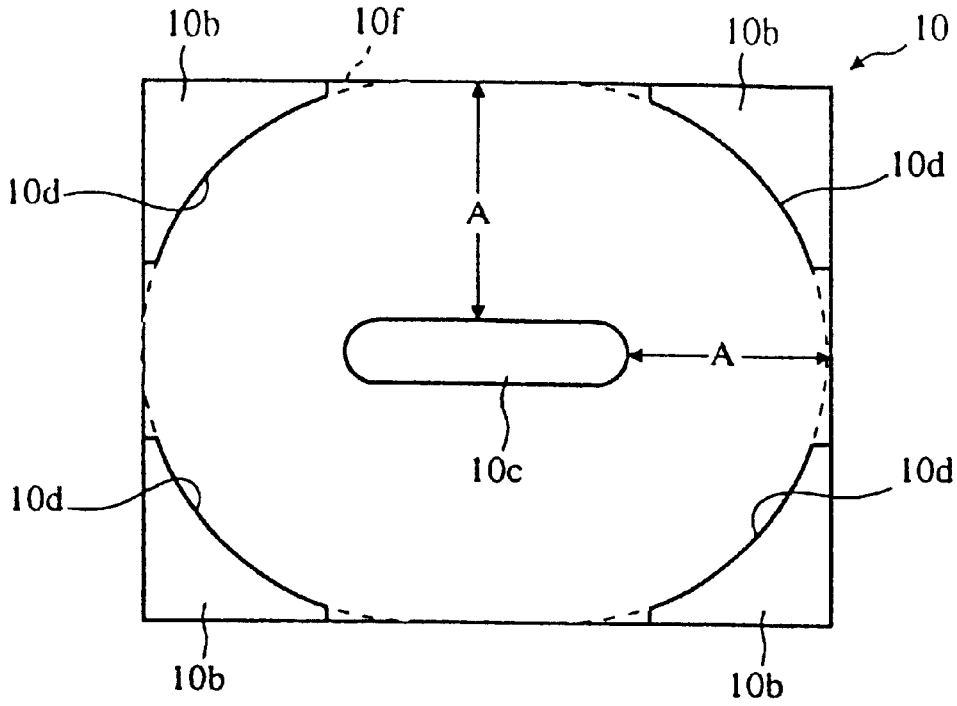
FIGS. 2A and 2B are a plan view of a first magnetic core and a sectional view of the first magnetic core and a second magnetic core, respectively.
Figure 2B:
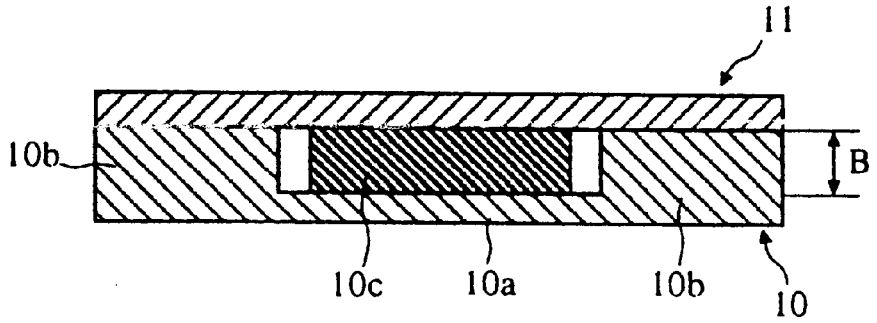

FIGS. 2A and 2B are a plan view of the first magnetic core 10, and a sectional view showing a state in which the second magnetic core 11 is placed upon the first magnetic core 10. As shown in these figures, in the embodiment, a winding width A of the winding accommodating portion 10*e* is greater than a thickness B of the winding accommodating portion 10*e*. This makes it possible to make the entire transformer thinner. As shown in FIG. 2A, the shape of the first magnetic core 10 is determined so that an external line 10*f* of the winding accommodating portion 10*e* contacts each side of the first magnetic core 10. This makes it possible to minimize the amount of dead space.

Figure 3A:
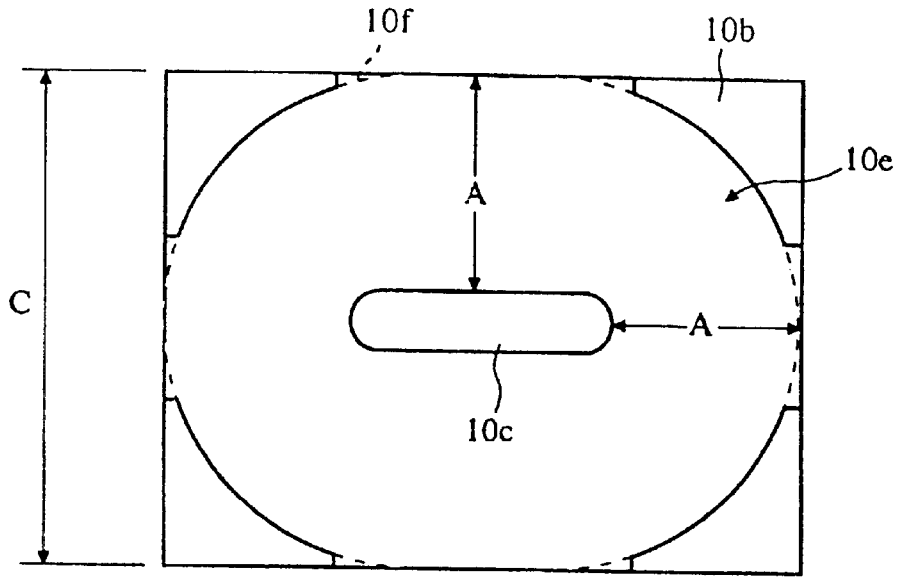
FIGS. 3A and 3B are plan views showing the first magnetic core of the embodiment and a corresponding magnetic core of a conventional transformer, respectively, for comparison purposes.
Figure 3B:
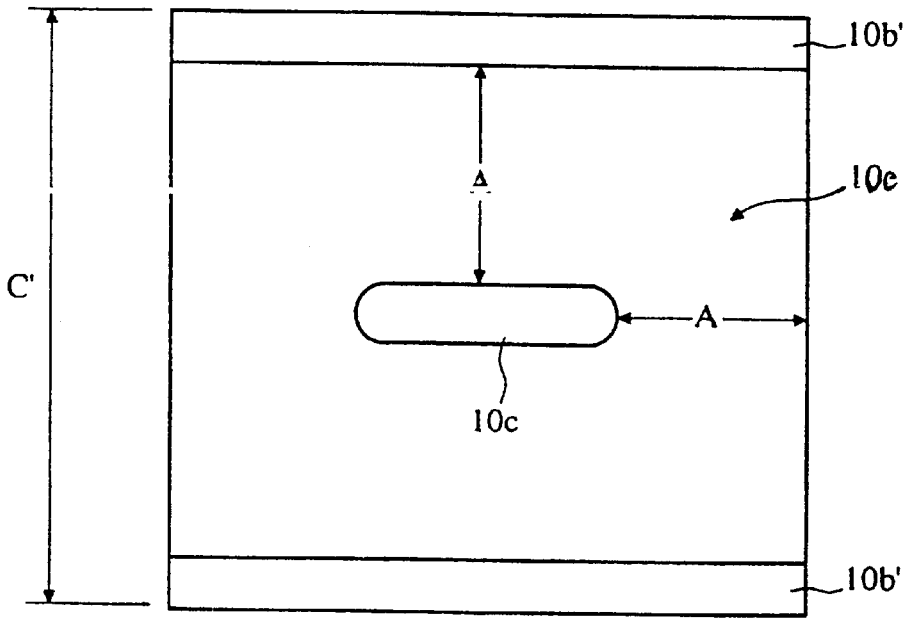
FIG. 3B PRIOR ART

FIGS. 3A and 3B illustrate, respectively, the first magnetic core 10 of the above-described embodiment and a corresponding magnetic core of a conventional transformer, and are used for comparison purposes. FIG. 3A is a plan view of the first magnetic core used in the transformer of the embodiment of the present invention. FIG. 3B shows a corresponding portion of the conventional transformer. In FIG. 3A, the portion represented by dotted lines corresponds to the external line 10*f* of the winding accommodating portion 10*e*, and the coil portions 12*a* to 12*c* of the coil 12 are placed upon each other and are inserted into the winding accommodating portion 10*e*.

On the other hand, when the conventional transformer shown in FIG. 3B is also constructed so that coil portions of the same shapes are placed upon each other and are inserted into its winding accommodating portion, the width of the conventional transformer becomes longer than the transformer of the embodiment of the present invention by an amount corresponding to the widths of outer legs 10*b*' disposed at the upper and lower portions of the conventional transformer in FIG. 3B. That is, C'>C. This means that the transformer of the embodiment of the present invention shown in FIG. 3A can be made smaller and thinner than the conventional transformer.

In the structure shown in FIG. 1, since the structure due to the arrangement of the coil portions 12*a* to 12*c* of the coil 12 and the structure of the first magnetic core 10 are symmetrical, the magnetic flux distribution at the first magnetic core 10 becomes uniform, so that leakage magnetic flux and EMI noise can be reduced. In addition, since the coil 12 and the first magnetic core 10 are disposed so as to contact each other or so as to be close to each other, and with their edges coinciding in plan view, the thermal distribution becomes uniform in a plane, thereby providing the advantage that hot spots cannot be easily formed in any portion inside the transformer.

Figure 4:
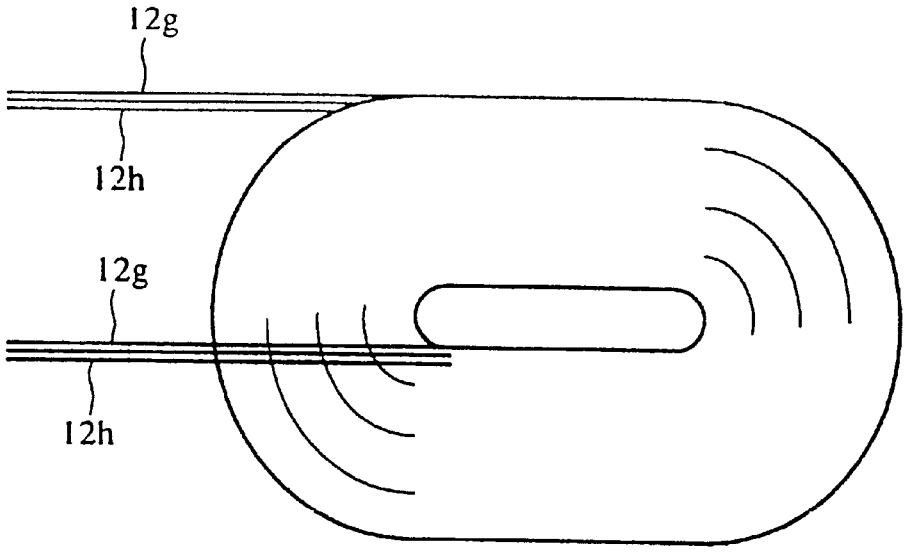
FIG. 4 is a plan view of another example of a coil.

Although the above-described coil 12 is formed by winding one self-fusing, three-layer insulating wire, it may be formed by placing two wires 12*g* and 12*h* parallel to each other and winding them in a flat manner as shown in FIG. 4.

Figure 5:
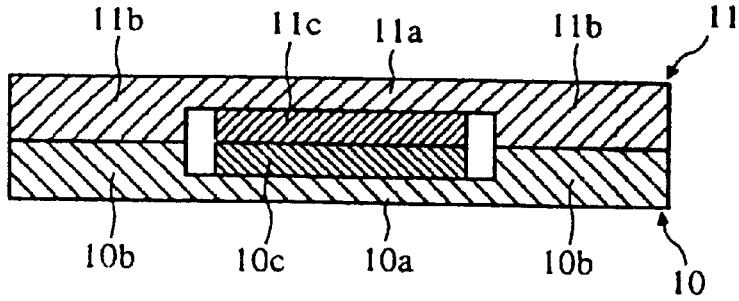
FIG. 5 is a vertical sectional view of another embodiment of a transformer in accordance with the present invention.

Although in the embodiment shown in FIG. 1 the second magnetic core 11 is a flat plate, the first magnetic core 10 and the second magnetic core 11 can be formed so as to have the same shape, as shown in FIG. 5. More specifically, in the second magnetic core 11, outer legs 11*b* are provided in a standing manner at the four corners of a rectangular flat plate 11*a,* and a middle leg 11*c* is provided in a standing manner at the central portion thereof. Then, the first magnetic core 10 and the second magnetic core 11 are abutted against each other in order to form a winding accommodating portion at the inner sides thereof. This makes it possible to manufacture one fewer component part. In order not to prevent the transformer as a whole from becoming thicker, it is necessary to make the thicknesses of the first magnetic core 10 and the second magnetic core 11 small.

Figure 6A:
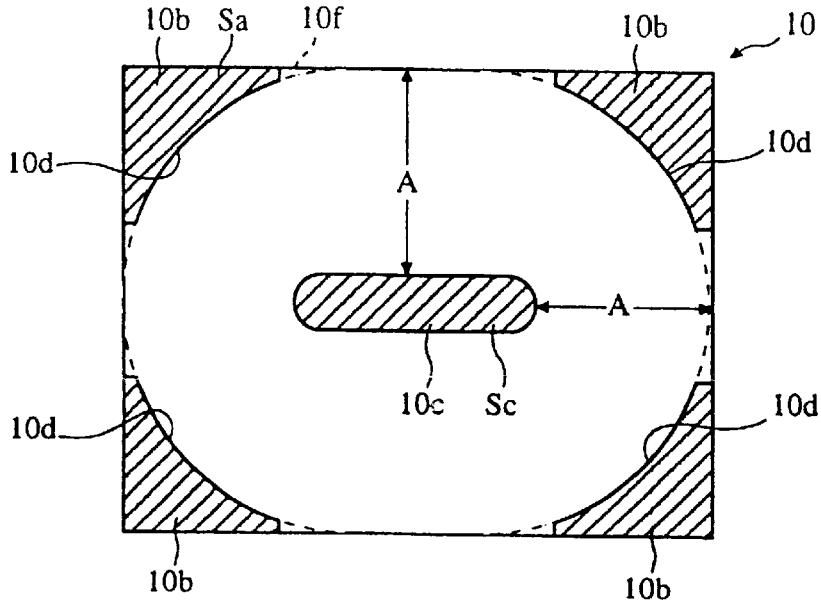
FIGS. 6A and 6B are a plan view and a perspective view of the first magnetic core, respectively.
Figure 6B:
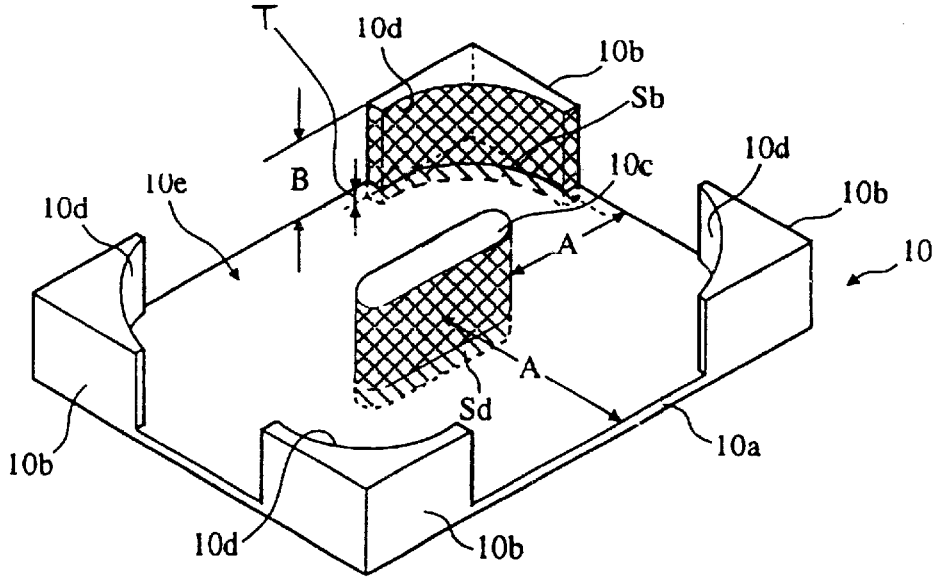

FIGS. 6A and 6B are a plan view and a perspective view of the first magnetic core 10, respectively.

Here, in these figures, an area of a cross-section of one outer leg 10 in plan view is represented by Sa, an area of an inwardly facing portion of an area determined by the product of a cross sectional peripheral length of the one outer leg 10*b* and the thickness of the flat plate having a polygonal shape is represented by Sb, an area of a cross-section of the middle leg 10*c* in plan view is represented by Sc, and an area determined by the product of a cross sectional peripheral length of the middle leg 10*c* and the thickness of the polygonal flat plate is represented by Sd. It is possible to restrict the reduction of induction caused by the concentration of magnetic flux at portions other than the middle leg 10*c,* when the following conditions (a), (b), and (c) are satisfied:

(a) The area Sd determined by the product of the cross sectional peripheral length of the middle leg 10*c* and the thickness T of the polygonal flat plate is substantially the same as or greater than the area Sc of the cross section of the middle leg 10*c* in the direction of a plane (that is, $Sd \geqq Sc$).

(b) The total sum of the areas Sa of the cross sections of the corresponding outer legs 10*b* in plan view is substantially equal to or greater than the area Sc of the cross section of the middle leg 10*c* in plan view (that is, area Sa×number of outer legs$\geqq$Sc)

(c) The total sum of the areas Sb of the inwardly facing portions of the areas determined by the products of the cross sectional peripheral lengths of the corresponding outer legs 10*b* and the thickness T of the flat plate having a polygonal shape is substantially equal to or greater than the area Sc of the cross section of the middle leg 10*c* in plan view (area Sb×number of outer legs$\geqq$Sc).

Figure 7:
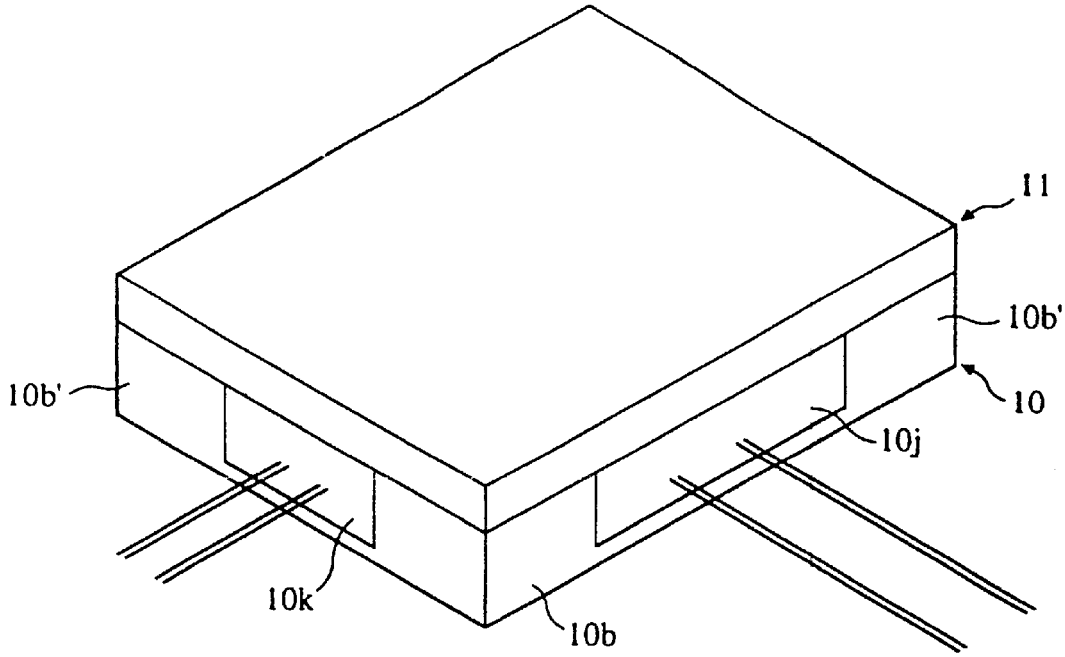
FIG. 7 is an external view of still another embodiment of a transformer in accordance with the present invention.
Figure 8A:
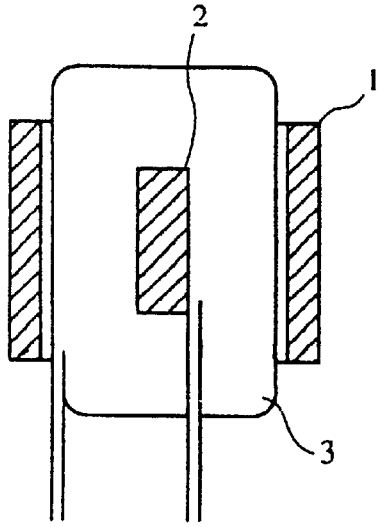
FIG. 8A PRIOR ART
FIGS. 8A and 8B are a front view and a plan view of a conventional transformer, respectively.
Figure 8B:
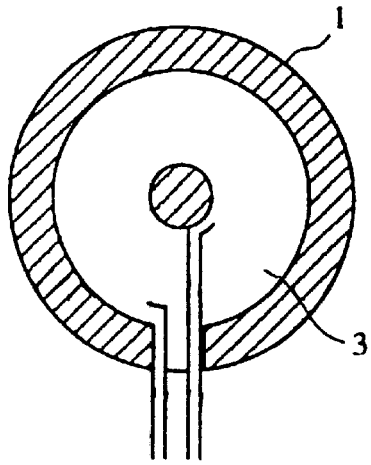
FIG. 8B PRIOR ART

FIG. 7 illustrates another embodiment of a transformer in accordance with the present invention.

In FIG. 1, the transformer is constructed so that the leads of the coil 12 are all drawn out parallel to each other. In contrast, in the embodiment shown in FIG. 7, the transformer is constructed so that the leads of the transformer are drawn out perpendicular to each other. Of the openings provided at locations where the outer periphery of the winding accommodating portion and the external form of the polygonal magnetic core are disposed close to each other or in contact each other, the required openings are used to draw out the leads, thereby making it possible to dispose the transformer at a greater variety of locations.

The present invention makes it possible to provide the following advantages.

(1) When the middle leg of the first magnetic core is formed with a circular shape or a substantially elliptical shape, when the outer periphery of the winding accommodating portion is formed with the same shape as this, and when the outer periphery of the winding accommodating portion and each of the sides of the external form of the magnetic core are such as to be disposed close to each other or in contact with each other, the size of the dead space becomes smaller, so that the footprint area of the entire transformer becomes small. Therefore, the dead space that exists during the mounting can be virtually eliminated, thereby making it possible to increase the efficiency with which the mounting operation is carried out, and to reduce the size and thickness of the transformer.

(2) By minimizing within the entire magnetic path the area of the cross section of the middle leg in plan view, it is possible to restrict the reduction of induction caused by the concentration of magnetic flux at other portions of the magnetic core.

(3) By drawing out the leads of the coil from openings that are not located on the same straight line, the transformer can be disposed at a greater variety of locations.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A transformer comprising:

a coil which is elongated and at least partially curved in its outer peripheral shape, said coil including at least a first substantially flat winding;

a first magnetic core including a plate, a middle leg provided in a standing manner at the central portion of the plate and outer legs provided in a standing manner at a plurality of corners of the plate, the first magnetic defining, between the middle leg and the outer legs, an elongated and at least partially curved winding accommodating portion sized and shaped for accommodating the coil therein; and a second magnetic core mounted on the first magnetic core;

wherein a cross-sectional shape of the middle leg is at least partially curved;

wherein a curved portion of a cross-sectional outer peripheral shape of the middle leg has the shape of an arc formed substantially concentrically wit a curved portion of an outer periphery of the winding seen accommodating portion; and wherein said outer periphery of the winding accommodating portion is formed so as to be close to or substantially coincide the side portions of an external shape of the first magnetic core, said side portions being defined respectively between the outer legs.

2. A transformer according to claim 1, wherein a plurality of leads of the coil are drawn out from different respective openings in the first magnetic core that are not on opposite sides of the first magnetic core.

3. A transformer according to claim 1, wherein a winding width of the winding accommodating portion is greater than a thickness of the winding accommodating portion.

4. A transformer according to claim 1, wherein the transformer has a width dimension in the direction of said plate, and a height dimension perpendicular thereto which is less than said width dimension.

5. A transformer according to claim 1, wherein the coil comprises a self-fusing, three-layer insulating wire.

6. A transformer according to claim 1, wherein the coil is formed by two or more wires wound parallel to each other in a flat shape.

7. A transformer according to claim 1, wherein at least part of said cross-sectional shape of the middle leg is straight.

8. A transformer according to claim 1, wherein the cross-sectional shapes of said middle leg and said winding accommodating portion are substantially the same.

9. A transformer according to claim 1, wherein the cross-sectional shapes of said middle leg and said winding accommodating portion are substantially the same.

10. A transformer according to claim 1, wherein an inner cross-sectional shape of said coil and said outer cross-sectional shape of said middle leg are substantially the same.

11. A transformer according to claim 10, wherein at least part of said cross-sectional shape of the middle leg is straight.

12. A transformer according to claim 11, wherein the cross-sectional shapes of said middle leg and said winding accommodating portion are substantially the same.

13. A transformer comprising:

a coil including at least a first substantially flat winding;

a first magnetic core including a plate, a middle leg provided in a standing manner at the central portion of the plate and outer legs provided in a standing manner at a plurality of corners of the plate, the first magnetic defining, between the middle leg and the outer legs, a winding accommodating portion for accommodating the coil therein; and a second magnetic core mounted on the first magnetic core;

wherein a cross-sectional ape of the middle leg is at least partially curved;

wherein a curved portion of a cross-sectional outer peripheral shape of the middle leg has the shape of an arc formed substantially concentrically with a curved portion of an outer periphery of the winding accommodating portion;

wherein said outer periphery of the winding accommodating portion is formed so as to be close to or substantially coincide with side portions of an external shape of the first magnetic core, said side portions being defined respectively between the outer legs; and wherein an area determined by the product of a cross-sectional peripheral length of the middle leg and a thickness of the plate is substantially equal to or greater than a cross-sectional area of the middle leg.

14. A transformer comprising:

a coil including at least a first substantially flat winding;

a first magnetic core including a plate, a middle leg provided in a standing manner at the central portion of the plate and outer legs provided in a standing manner at a plurality of corners of the plate, the first magnetic core defining, between the middle leg and the outer legs, a winding accommodating portion for accommodating the coil therein; and a second magnetic core mounted on the first magnetic core;

wherein a cross-sectional shape of the middle leg is at least partially curved;

wherein a curved portion of a cross-sectional outer peripheral shape of the middle leg has the shape of an arc formed substantially concentrically with a curved portion of an outer periphery of the winding accommodating portion;

wherein said outer periphery of the winding accommodating portion is formed so as to be close to or substantially coincide with side portions of an external shape of the first magnetic core, said side portions being defined respectively between the outer legs; and wherein the total sum of cross-sectional areas of the outer legs is substantially equal to or greater than a cross-sectional area of the middle leg.

15. A transformer comprising:

a coil including at least a first substantially flat winding;

a first magnetic core including a plate, a middle leg provided in a standing manner at the central portion of the plate and outer legs provided in a standing maimer at a plurality of corners of the plate, the first magnetic core defining, between the middle leg and the outer legs, a winding accommodating portion for accommodating the coil therein; and a second magnetic core mounted on the first magnetic core;

wherein a cross-sectional shape of the middle leg is at least partially curved;

wherein a curved portion of a cross-sectional outer peripheral shape of the middle leg has the shape of an arc formed substantially concentrically with a curved portion of an outer periphery of the winding accommodating portion;

wherein said outer periphery of the winding accommodating portion is formed so as to be close to or substantially coincide with side portions of an external shape of the first magnetic core, said side portions being defined respectively between the outer logs; and wherein the total sum of areas of inwardly facing portions of areas determined by products of cross-sectional peripheral lengths of the corresponding outer legs and a thickness of the plate is substantially equal to or greater than a cross-sectional area of the middle leg.

16. A transformer comprising:

a coil which is elongated and at least partially curved in its outer peripheral shape, said coil including at least a first substantially flat winding;

a first magnetic core including a plate, a middle leg provided in a standing manner at the central portion of the plate and outer legs provided in a standing wanner at a plurality of corners of the plate, the first magnetic core defining, between the middle leg and the outer legs, a winding accommodating portion sized and shaped for accommodating the coil therein; and a second magnetic core mounted on the first magnetic core;

wherein an outer periphery of the winding accommodating portion is formed so as to be close to or substantially coincide with side portions of an external shape of the first magnetic core, said side portions being defined respectively between the outer legs.

17. A transformer according to claim 16, wherein a cross-sectional shape of the middle leg is elongated and at least partially curved.

18. A transformer according to claim 17, wherein a curved portion of a cross-sectional outer peripheral shape of the middle leg has the shape of an arc formed substantially concentrically with a curved portion of said outer periphery of the winding accommodating portion.

19. A transformer comprising:

a coil including at least a first substantially flat winding;

a first magnetic core including a plate, a middle leg provided in a standing manner at the central portion of the plate and outer legs provided in a standing manner at a plurality of corners of the plate, the first magnetic core defining, between the middle leg and the outer legs, a winding accommodating portion sized and shaped for accommodating the coil therein; and a second magnetic core mounted on the first magnetic core;

wherein a cross-sectional shape of the middle leg is at least partially curved;

wherein a curved portion of a cross-sectional outer peripheral shape of the middle leg has the shape of an arc formed substantially concentrically with curved portion of an outer periphery of the winding accommodating portion; and wherein said outer periphery of the winding accommodating portion is fanned so as substantially coincide with and not to project from at least two side portions of an external shape of the first magnetic core, said side portions being defined respectively between the outer legs.

20. A transformer according to claim 19, wherein said coil tins an outer periphery and is disposed so that said outer periphery substantially coincides with and does not project from said at least two side portions of an external shape of the first magnetic core.

* * * * *